US009972056B2

(12) United States Patent
Wilkins et al.

(10) Patent No.: US 9,972,056 B2
(45) Date of Patent: May 15, 2018

(54) PET MATCHING SYSTEM AND METHOD

(71) Applicant: 20/20 Profiles, LLC, Boulder, CO (US)

(72) Inventors: Emily Ann Wilkins, Austin, TX (US); Jeffrey Kohl Wilkins, Boulder, CO (US)

( * ) Notice: Subject to any disclaimer, the term of this patent is extended or adjusted under 35 U.S.C. 154(b) by 955 days.

(21) Appl. No.: 14/451,388

(22) Filed: Aug. 4, 2014

(65) Prior Publication Data

US 2015/0046354 A1 Feb. 12, 2015

Related U.S. Application Data

(60) Provisional application No. 61/863,121, filed on Aug. 7, 2013.

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01
See application file for complete search history.

(56) References Cited

U.S. PATENT DOCUMENTS 8,751,481 B2 * 6/2014 Camoglu ..... G06F 17/30867 707/713
2007/0294615 A1 * 12/2007 Sathe ..... G06F 17/30702 707/803
2011/0231241 A1 * 9/2011 Kesari ..... G06F 17/30699 705/14.42
2011/0264648 A1 * 10/2011 Gulik ..... G06F 17/30867 707/722
2013/0066675 A1 * 3/2013 Bercaw ..... G06Q 30/0201 705/7.29

* cited by examiner

*Primary Examiner* — Andrew Georgandellis
(74) *Attorney, Agent, or Firm* — Miller Law Group, PLLC

(57) ABSTRACT

Computer-implemented pet adoption systems, methods and computer program products improve the process of matching up prospective adopters with available animals by optimizing the number of pet profiles displayed to prospective adopters per page, providing authorized personal with different selectable rules for setting the order in which the animal profiles are displayed to the prospective adopter in order to work toward specific adoption goals of the animal shelter, and using historical usage and user-profile data to gauge the probability of adoption between a prospective adopter and the available animals. The probabilistic analysis is used for the purpose of ranking or filtering the pool of pet profiles in order to remove pets of lower adoption-probability from consideration or present them lower down in the displayed order of the profiles.

3 Claims, 7 Drawing Sheets

Display Number Management System

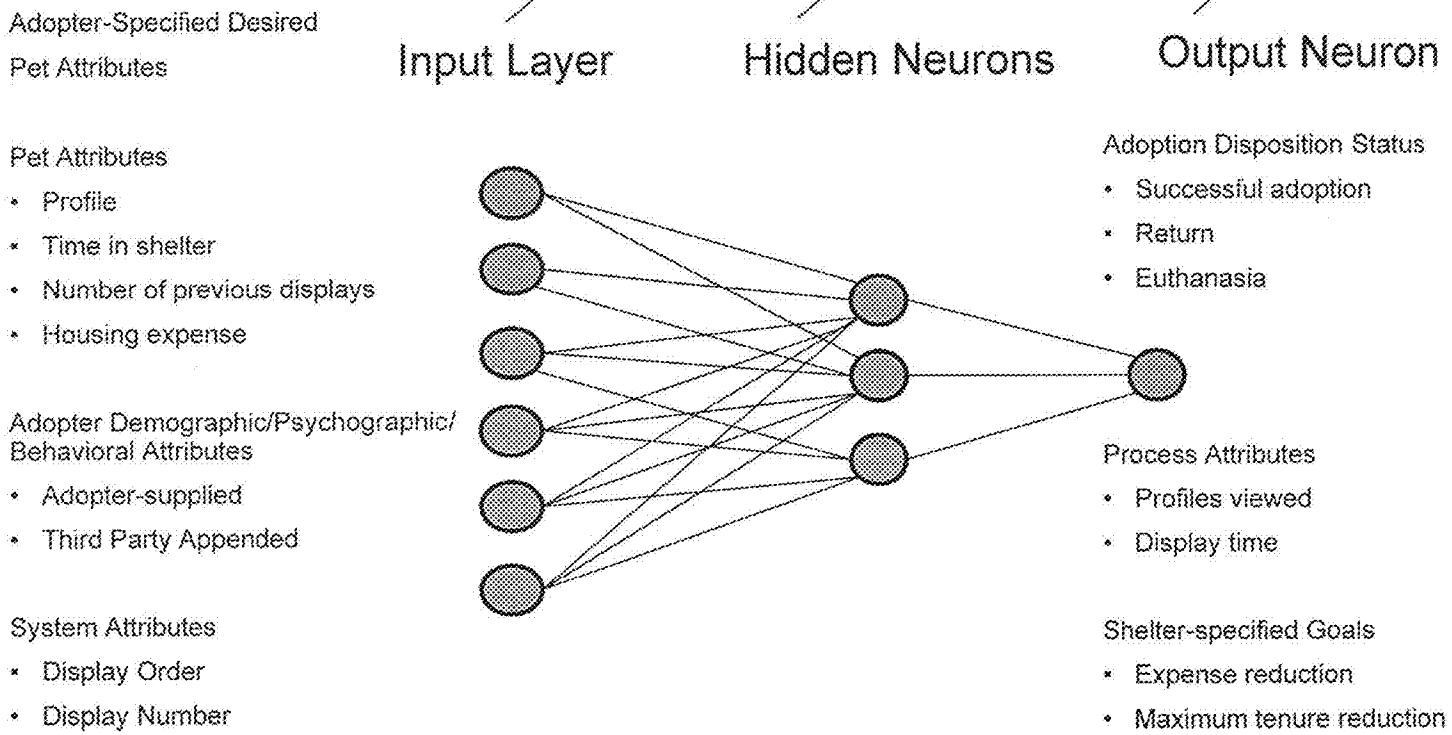
Fig. 4: Neural Network Architecture

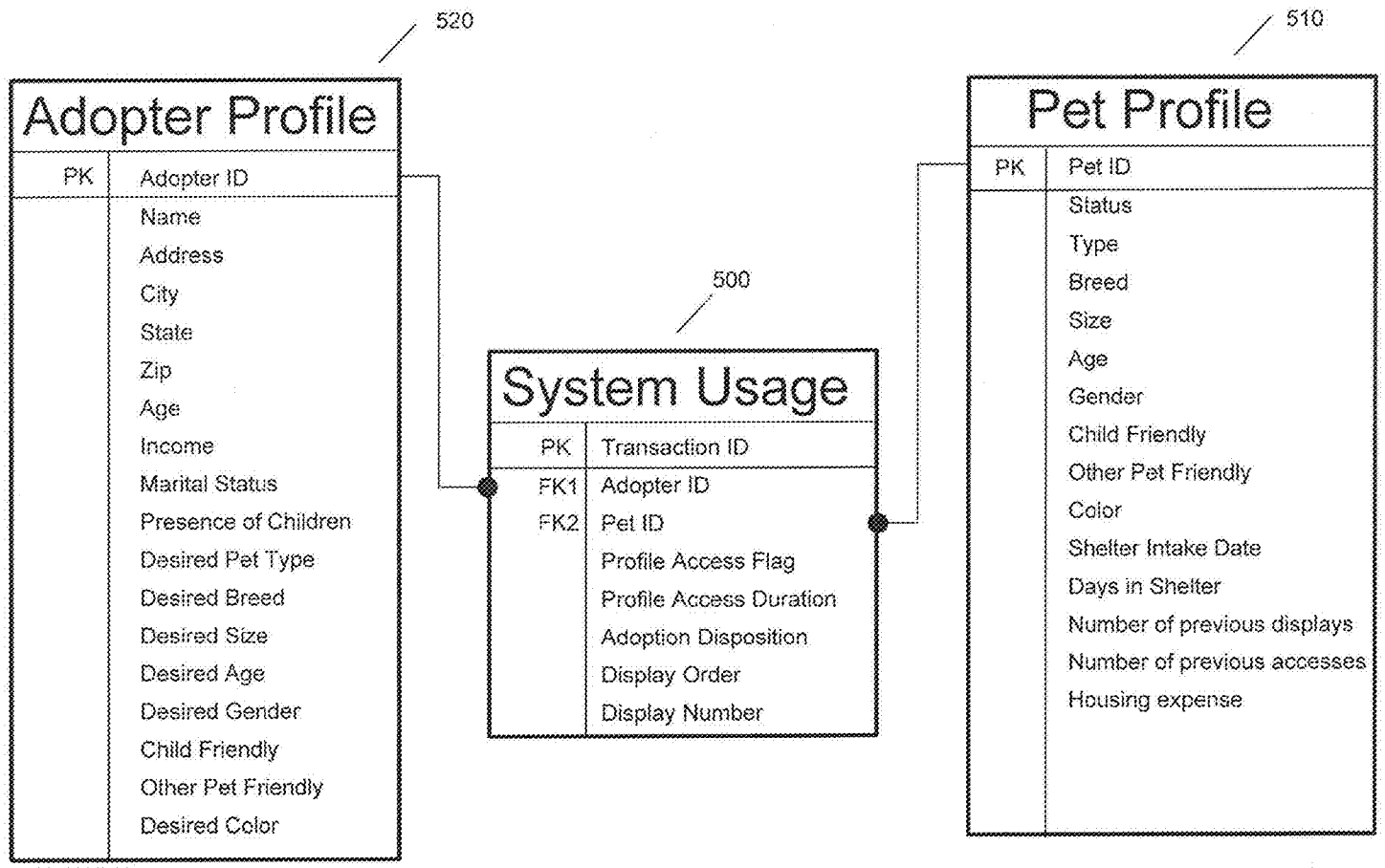
Fig. 5: Pet Matcher Logical Data Model

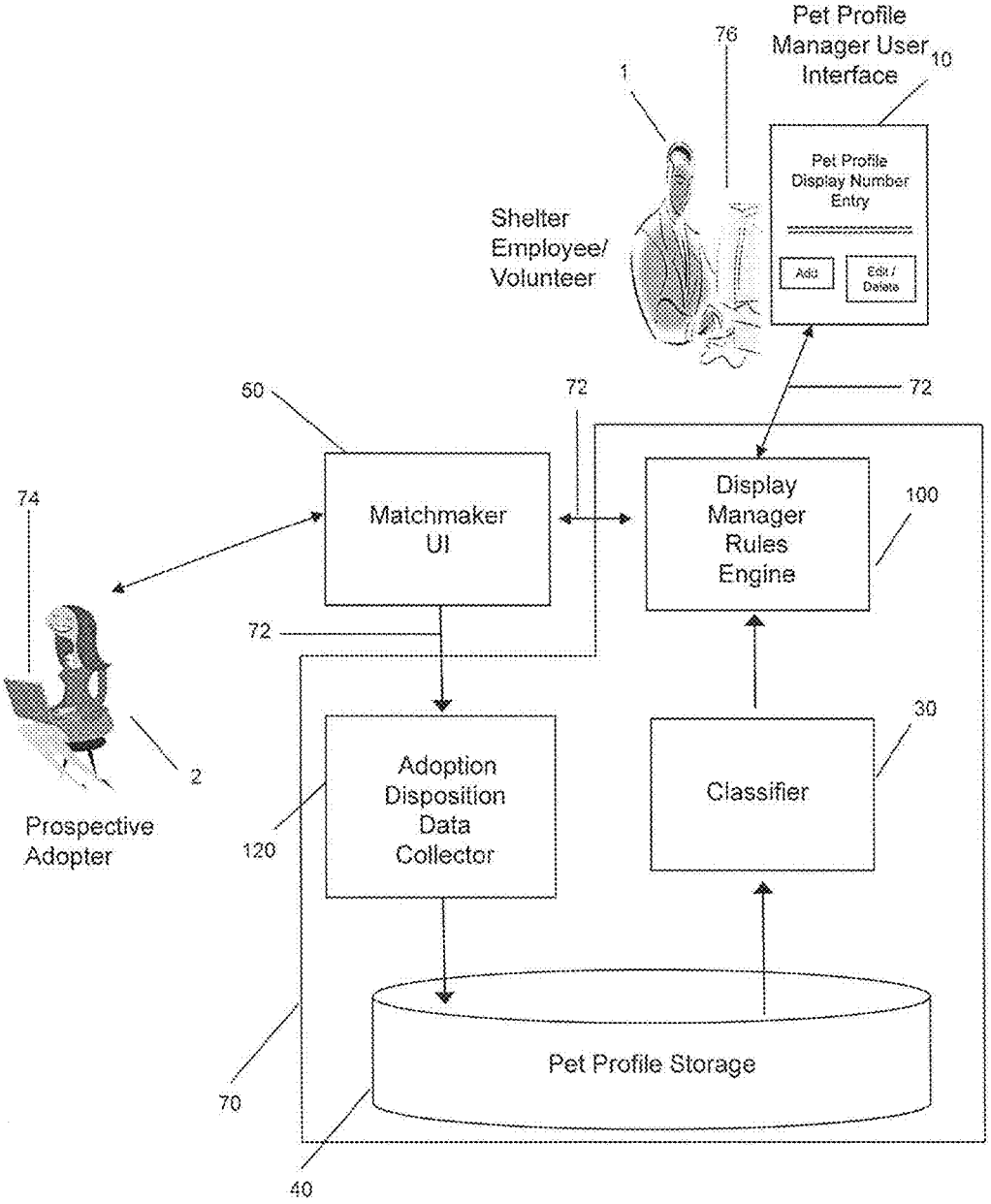
Fig. 6: Display Order Management System

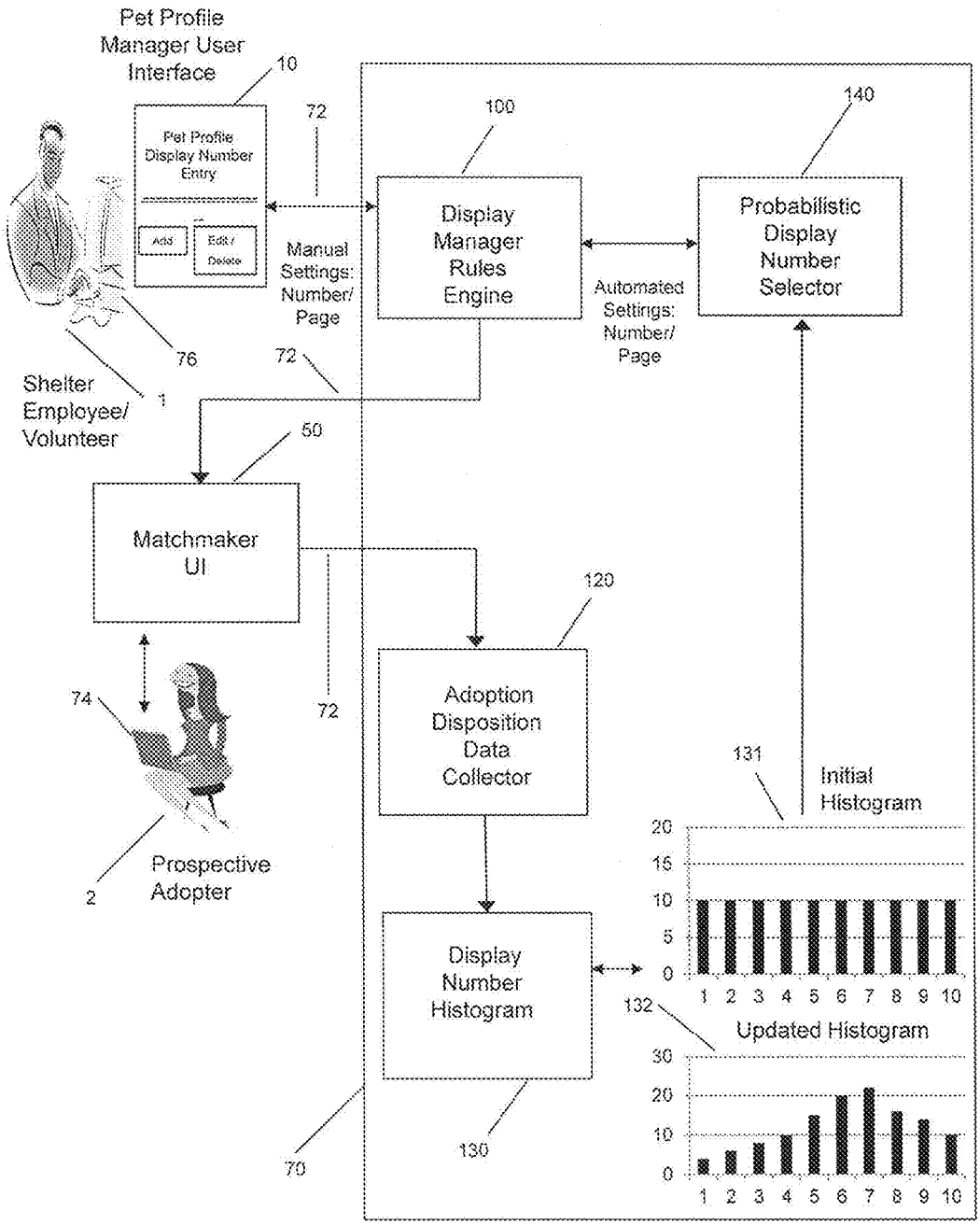
Fig. 7: Display Number Management System

PET MATCHING SYSTEM AND METHOD

This application claims the benefit under 35 U.S.C. 119(e) of U.S. provisional application Ser. No. 61/863,121, filed Aug. 6, 2013, the entirety of which is incorporated herein by reference.

FIELD OF THE INVENTION

This invention relates generally to the field of cross-matching in determining whether one is compatible with another. More particularly, this invention relates a new pet matching system, method, and computer program product useful for matching pet adopters and shelter animals.

BACKGROUND

According to the Humane Society of the United States and the American Humane Society, more than 6 million animals enter a network of more than 3,500 animal shelters in the United States each year. The vast majority of these animals are dogs and cats.

Shelter animals face a daunting future. According to the National Council on Pet Population Study and Policy (NCPPSP), less than 2 percent of cats and only 15 to 20 percent of dogs are returned to their owners. Most of these were identified with tags, tattoos or microchips, which accounts for the lower rate of cat returns. An estimated 24.9% of dogs and 23.4% of cats that enter shelters are adopted. Approximately 56% of dogs and 71% of cats that enter shelters are euthanized. The scale is sobering; an estimated 3.7 million shelter dogs and cats are euthanized each year.

In addition to the animal suffering, the costs to taxpayers and private donors are significant. While no definitive data are available, the costs can be estimated using available information. For example, the 2012 Public Animal Shelter Report from the North Carolina Department of Agriculture and Consumer Services reports an average cost per animal handled of $131.08. Assuming 6 million animals are processed each year in the United States, total expenditures would top $786 million.

To help prospective adopters identify a pet of interest, animal shelters typically provide Internet web access to pet profiles. In the most rudimentary case, simple lists are presented based on pet type (e.g. dog or cat). An example of this limited profile access is shown in FIG. 1, which is available at the Boulder Valley Humane Society, Boulder Colo. website at <<http://www.boulderhumane.org>>.

In some cases, prospective pet adopters can search the Internet based on attributes such as breed, gender, age, size, and other factors such as whether the animal is housebroken and gets along with other animals and children. An example of this more advanced search capability is shown in FIG. 2, which is available at the Petfinder website at <<http://www.petfinder.org>>.

Although web-based access and search is a significant improvement, the high euthanasia rate and low adoption rate indicate significant room for improvement exists. In addition, adoptions are characterized by a significant return rate. According to the American Society for the Prevention of Cruelty to Animals, more than 20% of people who leave dogs in a shelter adopted them from a shelter. Returns are particularly costly and disruptive for the shelter, pet, and prospective adopter.

Current approaches suffer from a number of significant shortcomings that limit their utility. One limitation of current approaches includes the identification of suitable pets when all of the match criteria are not met. Existing systems, such as PetFinder, simply apply the search criteria as filters to available pet inventory. Should the search prove overly restrictive, all pet profiles in the pet inventory are filtered out and no pet profiles are returned. The present disclosure addresses this shortcoming in some embodiments by returning a group of pet profiles that most closely match the desired profile. Since not all desired attributes may be of equal importance, in some embodiments, one or more attributes can be weighted when assessing similarity.

A further complication results from tasking the prospective adopter with fully knowing what sort of pet they are seeking. For example, it is not clear that prospective adopter's desired attributes are in fact predictive of a successful adoption. Current systems do not incorporate pet disposition data to refine recommendations to highlight pets not only likely to be selected, but to result in an adoption. Embodiments of the present invention can address this limitation by explicitly incorporating pet selection, adoption, and return data in a pet matching system.

Further, existing systems labor under the assumption that there is a "best" match that can be defined solely by pet attributes. This myopic focus on attributes of the pet to be adopted, excluding demographic, psychographic and behavioral attributes of the prospective adopter, results in less than optimal recommendations. Embodiments of the present invention can address this shortcoming by incorporating demographic, psychographic, and/or behavioral data into a pet matching process.

Existing systems also exhibit other shortcomings beyond their matching/pet profile selection algorithm. When faced with pages of pet profiles to review, prospective adopters disproportionately choose pets from the first pages. The number of pet profiles and the order in which they are displayed to the prospective adopter are not governed by explicit business rules designed to further the animal shelter's goals. Often, matching profiles are pulled and displayed in the order in which they are identified from an underlying pet profile database.

Accordingly, there remains room for improvement in the field of computer-implemented animal adoption systems for matching up prospective adopters with available pets for adoption, and Applicant has developed a new solution that addresses at least some of the shortcomings of the prior art.

SUMMARY OF THE INVENTION

According to one aspect of the invention there is provided a method of optimizing a display quantity of adoptable pet profiles that are to be displayed to a prospective pet adopter in a computer-implemented animal adoption system, the method comprising:

(a) for each one of a plurality of prospective pet adopters,
  (i) receiving by a server system a search request over a communications network from a respective remote client device operated by said prospective pet adopter; and
  (ii) in response to the search request from the respective remote client device of said prospective pet adopter, serving by the server system a plurality of adoptable pet profiles to a browser of the respective remote client device for display of said adoptable pet profiles in a user interface that includes a selection tool for allowing said prospective pet adopter to select for adoption any of the plurality of pet profiles served to said respective remote client device, which varies in number among different occurrences of step (a)(ii);

(b) (i) determining by the server system at least one matched-up adopter based on receipt by the server system of confirmation from the respective remote client device of said matched-up adopter that a selected animal for adoption was chosen by said matched-up adopter from among the plurality of pet profiles that were served to the respective remote client device of said matched-up adopter in step (a)(ii);

(ii) for each matched-up adopter determined in step (b)(i), updating by the server system usage-tracking data in order to both denote the occurrence of a match between the matched-up adopter and the respective selected animal, and associate this match with the number of pet profiles from among which the respective selected animal was chosen; and (c) for an additional prospective pet adopter, performing a subsequent occurrence of each of steps (a)(i) and (a)(ii), and during said subsequent occurrence of step (a)(ii), setting by the server system the number of pet profiles to be served to the respective remote client device of said additional prospective pet adopter based at least partially on stored information from the usage data accumulated from multiple occurrences of step (b)(ii) concerning the achieved matches and the number of pet profiles from which the selected animal of each achieved match was chosen.

Step (b) may include:

(iii) determining by the server system at least one unmatched prospective adopter based on a lack of any selection made by said unmatched prospective adopter from the plurality of pet profiles that were served to the respective remote client device of said unmatched prospective adopter;

(iv) for each unmatched prospective adopter determined in step (b)(iii), updating by the server system the usage-tracking data in order to denote a lack of achieved adoption between the unmatched prospective adopter and the pet profiles served thereto, and associate this lack of achieved adoption with the number of pet profiles that were served to said unmatched prospective adopter;

and wherein the stored information used in setting the number of pet profiles in step (c) includes the updated usage-tracking data from step (b)(iv).

Preferably the updating of the usage-tracking data in step (b)(ii) comprises incrementing a frequency count value associated with the number of pet profiles from among which the respective selected animal was chosen.

Preferably the updating of the usage-tracking data in step (b)(iv) comprises decrementing the frequency count value associated with the number of pet profiles from among which no animal profile was selected for adoption by the unmatched prospective adopter.

Preferably the usage-tracking data comprises a histogram having a predetermined number of bins, each corresponding to a respective one of a plurality of predefined display numbers from which the number of pet profiles served in each occurrence of step (a)(ii) is selected by the server system.

Preferably the number of pet profiles to be served in the subsequent occurrence of step (a)(ii) is selected from among a plurality of predefined display numbers stored by the server system based on a calculation by the server system of which of said predetermined display numbers has the greatest probability of resulting in selection of one of the animal profiles by the additional prospective pet adopter, said calculation being based on the stored information from the usage data accumulated in multiple occurrences of step (b)(ii).

According to a second aspect of the invention, there is provided a method of setting a display order of pet profiles to be displayed to prospective pet adopters in a computer-implemented animal adoption system, the method comprising:

(a) at a server system connected to a communications network by which the server system can communicate with remote client devices operated by a plurality of prospective pet adopters, storing a rules engine in computer readable memory linked to a processor of the server system;

(b) receiving by the server system an input signal from an authorized user having authority to manage adoption of animals from an animal shelter organization, the input signal representing a selection by the authorized user from one of a plurality of different rule selection options displayed to said authorized user in a manager-level user interface displayed by a visual display of either the server system or a remote client device communicably linked thereto via the communications network or other connection, each rule selection option corresponding to a different respective display-order sorting rule stored within the rules engine;

(c) receiving by the server a request from the respective remote client device of any one of the plurality of prospective pet adopters to view adoptable pet profiles from which the prospective pet adopter can select a pet to adopt;

(d) by the server system, in response to the request, retrieving a plurality of adoptable pet profiles and sorting said plurality of adoptable pet profiles using a particular one of the respective display-order sorting rules from the rules engine based on which one of the rule selection options was selected by the authorized user in step (a), thereby generating display-order data concerning an order in which the plurality of adoptable pet profiles are to be displayed to the prospective pet adopter;

(e) using by the server system of the display-order data to serve the plurality of adoptable pet profiles to a browser of the respective remote client device of the prospective pet adopter from step (c) in a manner causing said browser to display the plurality of adoptable pet profiles in the order dictated by said display-order data.

Preferably each adoptable pet profile includes time data concerning a duration of time for which a subject pet of the adoptable pet profile has been within the care of the animal shelter organization, and the display-order sorting rules in the rule engine include at least one time-based display-order sorting rule.

Preferably the time data comprises an intake date on which the subject pet of the adoptable pet profile entered into the care of the animal shelter organization, or a running counter of the duration of time for which the subject pet has been within the care of the shelter organization.

Preferably the at least one time-based display-order sorting rule includes a first-in-first-out rule dictating that longer-term pet profiles with longer durations of time are ranked higher in the display-order data in order to display said longer-term pet profiles before shorter-term pet profiles in the browser of the respective remote client device of the prospective pet adopter.

Preferably the at least one time-based display-order sorting rule includes a last-in-first-out rule dictating that shorter-term pet profiles with shorter durations of time are ranked higher in the display-order data in order to display said shorter-term pet profiles before longer-term pet profiles in the browser of the respective remote client device of the prospective pet adopter.

Preferably each adoptable pet profile includes expense data concerning costs associated with ongoing care of a subject pet of the respective adoptable pet profile, and the display-order sorting rules in the rule engine include a cost-minimization rule.

In some embodiments, subject pets of the plurality adoptable pet profiles include pets staying at different shelter locations that are encompassed by, or associated with, the shelter organization, in which case each adoptable pet profile preferably includes pet location data concerning the shelter location at which the subject pet is located, and the display-order sorting rules in the rule engine preferably include a closest-shelter rule, and wherein the method preferably comprises receipt by the server of adopter location data concerning a location of the prospective adopter prior to step (d), and use of the pet location data and the adopter location data by the server in step (d) to first calculate a respective adopter-to-shelter distance between the location of the adopter and each of the different shelters of the plurality adoptable pet profiles, and then apply the closest-shelter rule to rank pet profiles of shorter adopter-to-shelter distance higher in the display order than pet profiles of greater adopter-to-shelter distance.

In one embodiment, the method includes:

by the server, receiving details of each of the plurality of prospective adopters and storing said details in a respective adopter profile;

repeating steps (c) through (e) for at least some of the prospective adopters other than the first prospective adopter from the first performance of steps (c) through (e), and for each and every occurrence of step (e):

tracking by the server whether an adoption is achieved based on whether the prospective adopter selects a pet for adoption from among the plurality of pet profiles displayed to said prospective adopter; and for each achieved-adoption, storing an adoption-achieved record that associates the adoptable pet profile of the selected pet for adoption with the adopter profile of the prospective adopter that selected the pet for adoption, and removing the selected pet for adoption from a pool of adoptable-pet profiles;

wherein step (d) for at least one of the prospective adopters comprises application by the server system of a probability-based rule from the rules engine, use by the server system of accumulated data on the achieved adoptions to determine a probability score for each remaining pet profile of the pool in relation to said one of the prospective adopters, and ranking by the server system of the remaining pet profiles in manner assigning higher rank in the display order to pet profiles of higher probability scores than to pet profiles of lower probability scores.

According to a third aspect of the invention, there is provided a method of improved match-making between prospective pet adopters and available pets for adoption in a computer-implemented animal adoption system that includes a server system connected to a communications network by which the server can communicate with remote client devices operated by the prospective pet adopters, the method comprising:

(a) for each one of a plurality of prospective pet adopters, (i) receiving by the server system details of said prospective adopter and storing said details in a respective adopter profile;

(ii) receiving by the server system a search request over the communications network from a respective one of the remote client devices that is operated by said prospective pet adopter; and (iii) in response to the search request from the respective remote client device of said prospective pet adopter, serving by the server system a plurality pet profiles from a pool of adoptable-pet profiles to a browser of the respective remote client device for display of said plurality pet profiles in a user interface that includes a selection tool for allowing said prospective pet adopter to select for adoption any of the plurality of pet profiles served to said respective remote client device, and determining by the server whether an adoption is achieved based on whether the prospective adopter selects a pet for adoption from among the plurality of pet profiles displayed to said prospective adopter;

(b) based on determination of achieved adoptions for at least some of the prospective adopters in respective occurrences of step (a)(iii), (i) storing of an adoption-achieved indicator by the server system for each achieved adoption in a manner associating said adoption-achieved indicator with data from the pet profile of the selected pet from the achieved adoption and with data from the adopter profile of the prospective adopter that selected the pet for adoption, and (ii) removal by the server system of the pet profile of the selected pet from each achieved adoption from the pool of adoptable pets; and (c) for an additional prospective pet adopter, (i) receiving by the server system details of said additional prospective adopter and storing said details in an additional adopter profile;

(ii) receiving by the server system an additional search request over the communications network from a respective one of the remote client devices that is operated by said additional prospective pet adopter; and (iii) determining by the server a probability score for each remaining pet profile in the pool of adoptable-pet profiles in relation to the additional prospective pet adopter by inputting data from both the additional adopter profile and the remaining pet profiles into a predictive model that is based at least partially on accumulated data from the pet and adopter profiles associated with the adoption-achieved indicators; and (iv) comparing by the server of the probability scores of the remaining adoptable pet profiles against a threshold, and/or against one another, to generate a filtered, and/or ranked, collection of the remaining adoptable pet profiles; and (v) serving by the server system the filtered and/or ranked collection of the remaining adoptable pet profiles to the browser of the respective remote client device of said additional prospective pet adopter for display of the filtered and/or ranked collection in the user interface of said respective remote client device of said additional prospective pet adopter to allow said additional prospective adopter to select an adoptable pet from the filtered and/or ranked collection of the remaining adoptable pet profiles.

In one embodiment, the filtered and/or ranked collection of the remaining adoptable pet profiles is ranked in order of probability score, and the collection is served to the additional prospective pet adopter in a manner causing the collection to be displayed in said same order within the user interface of said respective remote client device of said additional prospective pet adopter.

In one preferred embodiment:

each occurrence of step (a)(iii) comprises creation by the server of a respective usage-tracking data set for each pet profile viewed by the prospective adopter in the browser of the respective remote client device;

the usage-tracking data set creates an association between the adopter profile of the prospective adopter and the viewed pet profile;

the adoption-achieved indicator stored in step (b) is assigned to the respective usage-tracking data set;

at least one occurrence of step (a)(iii) is an results in no adoption, and the respective usage-tracking data set for said occurrence of step (a)(iii) is not subject to one of the adoption-achieved indicators assigned in step (b); and the predictive model in step (c)(iii) is based on a collection of both usage-tracking data sets that include adoption-achieved indicators and usage-tracking data sets that lack adoption-achieved indicators.

The method may further include the following additional steps:

(d) in response to return of an adopted animal from one of the achieved adoptions to an animal shelter from which said adopted animal was adopted, updating by the server of a usage-tracking data set in which the adoption-achieved indicator for said one of the achieved adoptions was stored by replacing said adoption-achieved indicator with an adoption-returned indicator;

(e) using the updated usage-tracking data set in a subsequent training of the predictive model to derive an updated predictive model; and (f) repeating step (c) for yet another additional prospective adopter using the updated predictive model.

According to another aspect of the invention, a computer readable medium has stored thereon computer readable statements and instructions that, when executed by a processor of the server system, cause the system to perform any one of more of the forgoing methods.

BRIEF DESCRIPTION OF THE DRAWINGS

Preferred embodiments of the present invention will now be described in conjunction with the accompanying drawings in which:

FIG. 4 schematically illustrates an example of a neural network architecture for generating a predictive model usable in place of, or in combination with, the classifier module of FIG. 3 in order to determine the probability of adoption between the prospective adopter and each available pet based on the adoption history of previous users of the system.

FIG. 5 illustrates an example of a logical data model for collecting and storing historical usage data of the system for use in training the predictive model.

FIG. 6 is a schematic block diagram of a computer implemented pet adoption system according to another embodiment of the present invention, in which a rules engine allows authorized personnel of the animal shelter to select from different possible sorting rules concerning the order in which adoptable animal profiles are displayed to the prospective adopter.

FIG. 7 is a schematic block diagram illustrating the addition of a display number optimization module to the system of FIG. 6, whereby the system sets the number of pet profiles displayed per page in each search and tracks the occurrence of successful adoptions in order to determine an optimal number of pet profiles to display per page in the next search in order to maximize the chance of adoption.

In the drawings like characters of reference indicate corresponding parts in the different figures.

DETAILED DESCRIPTION

New pet matching solutions that can address the shortcomings of existing approaches and increase the number and quality of pet adoptions are now described as follows.

General System Layout

Figure 3:
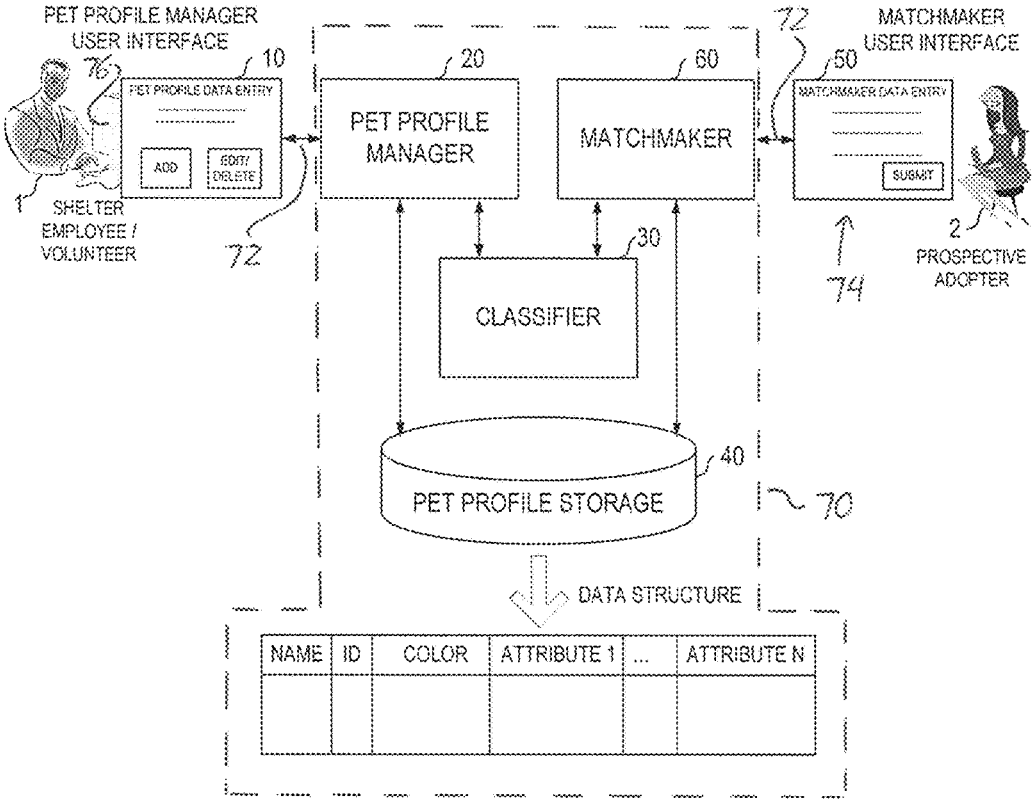
FIG. 3 is a schematic block diagram of a computer implemented pet adoption system according to one embodiment of the present invention, in which a classifier module determines suitable candidate pets for a prospective adopter on the basis of matching up pet profiles with desired pet attributes specified by the prospective adopter.

Referring to FIG. 3, a pet matching system in one embodiment of the present invention features a plurality of discrete modules, including pet profile manager user interface 10, pet profile manager 20, classifier 30, pet profile storage 40, matchmaker user interface 50, and matchmaker 60. The pet profile manager 20, classifier 30, pet profile storage 40, and matchmaker 60 are part of a server system 70 that includes at least one server computer having a processor, a computer readable medium linked thereto for execution by the processor of computer-executable statements and instructions stored on the computer readable medium, and a connection to a data-conveying communications network 72 such as the internet, by way of which the server can communicate with remote client devices 74, 76 operated by prospective pet adopters 2 and animal shelter employees or volunteers 1 or other authorized personnel of an animal shelter organization, which may operate a single shelter or multiple shelter locations. The pet profile manager 20, classifier 30, pet profile storage 40, and matchmaker 60 modules may be stored on a common computer readable medium of a single server computer for execution by the single server computer, or distributed across multiple computers that are communicably linked with another by suitable network connections.

Each remote device may be a desktop computer or workstation, laptop computer, tablet computer, mobile phone, other electronic device similarly equipped with a processor, a computer readable medium coupled thereto for execution by the processor of computer-executable statements and instructions stored on the computer readable medium, and a wired or wireless network connection for communication with the server system via the data communications network. The remote client device of the shelter personnel 1 presents the pet profile manager user 10 interface on a display screen of the device, for example in the form of a web page in a web browser of the device, just as the remote client device of the prospective adopter 2 presents the matchmaker user interface 50 on a display screen of the device, for example in the form of a web page in a web browser of the device. The server system 70 thus may employ one or more web servers for serving these pages to the prospective adopter users and the shelter personnel users. As an alternative to web browsers, the remote client devices may employ dedicated browser applications that are downloaded to these devices specifically for the purpose of browsing pet profiles served to the remote devices by the server system 70.

The pet profile manager user interface 10 can be configured for managing an "inventory" of pets available for adoption. In one embodiment, shelter employee/volunteer 1 may access pet profile manager user interface 10 in order to enter, update, and delete pet profile data that is then stored by the server. This data could include, without limitation, attributes such as:

- Name: Shelters commonly assign a name to their pets, to provide a more user friendly identifier than an ID number.
- ID: The shelter also assigns an identification number to each pet.
- Entry Date: Shelter entry date as of which the pet entered the care of the shelter organization.
- Disposition: Disposition documents whether the pet was ultimately adopted, euthanized, or returned to the owner.
- Exit Date: Date of adoption, euthanization, or return to owner.
- Pet Type: Dog, cat, etc.
- Breed: Pure breed animals may be so noted, or multiple breeds may be selected for mixed breed animals.
- Size: Size may be recorded categorically (e.g. small/medium/large), or by weight or weight range.
- Age: Pet age in years and months. In alternative embodiment, age might be entered using a range (ex. 0-2 years) instead of a discrete value.
- Living Environment: Does the pet live indoors, outdoors or both?
- Child-Friendly: Is the pet child friendly?
- Animal Compatible: Does the pet get along with other animals?
- Appropriate for Elderly: Is the pet suitable for an elderly adoptee, as demonstrated by attributes such as energy level.
- Housebroken: Is the pet housebroken?
- Spayed or Neutered. Has the animal been spayed or neutered?
- Hair length: Does the animal have long or short hair?
- Allergy sensitive: Is the animal suitable for allergy-sensitive pet adopters?
- Pet type specific: Is a cat declawed?

While the illustrated embodiment shows the shelter personnel as remotely accessing the server via a respective client device, the server remotely accessible by the prospective adopters may alternatively be located at the shelter, or at another location associated with the shelter organization that owns or manages the shelter, in which case authorized personnel may additionally or alternatively access the pet profile manager interface directly at the server system.

Updates, such as inactivating a record (i.e. removing the pet profile from a pool of available pets for adoption) when a pet is adopted, euthanized, or returned to its owner, may also be initiated through pet profile manager user interface 10. In some embodiments, pet profile manager user interface 10 may support single pet data entry or bulk import.

The pet profile manager 20 at the server 70 can be configured to receive pet data and addition, deletion, or update instructions from pet profile manager user interface 10. In some embodiments, pet profile manager 20 can be configured to process these instructions and implement the required reads and writes of pet profile data to the pet profile storage 40. In some embodiments, pet profile manager 20 can be configured to interface with classifier 30 to obtain a pet classification to aid in retrieval and match making.

Pet-Classification Based Matchmaking

The Classifier 30 is used to help select which pet profiles will be retrieved from the Pet Profile Storage and displayed to the Prospective Adopter. Most existing systems in the prior art simply return pets that exactly match a desired-pet profile supplied by the Prospective Adopter. These desired attributes act as filters that are applied to the available pet inventory. The current invention incorporates a number of enhancements to provide better matches to the Prospective Adopter.

In one embodiment, pets entered into the pet matching system can be assigned to a class computed by classifier 30. In some cases, a prospective adopter (e.g., prospective adopter 2 shown in FIG. 3) may have a definite pet type (e.g., dog or cat) in mind, and wish to choose the best fit based upon their desired-pet profile. This desired-pet profile can be created using available tools in the matchmaker user interface, which allow the prospective adopter to create a desired-pet profile by selecting from among predefined attributes in different categories. For ease of use, an initial classification can be based on pet type and color. Color in this case is a mnemonic to enhance the ease of use of the classifier. In some embodiments, classifier 30 can be implemented in Java using a method (e.g., computePetColor) which processes the pet profile data and assigns a color. Pets available for adoption can be assigned a color based on the similarity to a pre-defined color profile or template.

An example will now be described to illustrate the concept of color templates. In this example, a pet vector comprised of the Age Range (<1 year, 1-4 years or 4+ years), Living Environment (INDOOR/OUTDOOR/BOTH), Child-Friendly (YES/NO), Animal Compatible (true/false), Appropriate for Elderly (true/false) and Housebroken (true/false) is used to define a set of color templates. The resulting color definitions are as follows:

Dogs

Yellow={"<1 year", "BOTH", "YES", "true", "true", "true"};

Blue={"1-4 years", "INDOOR", "YES", "true", "true", "false"};

Red={"4+ years", "BOTH", "YES", "true", "true", "true"};

Purple={"1-4 years", "OUTDOOR", "NO", "false", "false", "true"};

Cats

Gold={"<1 year", "BOTH", "YES", "true", "true", "true"};

Navy={"1-4 years", "INDOOR", "YES", "true", "true", "false"};

Crimson={"4+ years", "BOTH", "YES", "true", "true", "true"};

Magenta={"1-4 years", "OUTDOOR", "NO", "false", "false", "true"};

When a pet available for adoption is entered into the pet matching system by the entry of a respective pet profile into the pet profile manager interface 10 by the shelter personnel, it can be assigned a color. In one embodiment of the present disclosure, pets are assigned to the color containing the most similar or closest template. This is referred to as a "nearest neighbor" classification rule. The assignment of pets to the "nearest" color requires a metric or distance function. When all of the attributes are symbolic, the traditional way of adapting the nearest neighbor rule is to resort to the 'overlap' metric which simply counts the number of attributes that have different values for the two instances being compared. This is commonly called the Hamming distance. In alternative embodiments of the present disclosure, other metrics may be used.

An example of the Hamming rule will now be described. Suppose a dog entering the shelter has the following attributes:

{"1-4 years", "INDOOR", "YES", "true", "true", "false"};

The Hamming distance to each dog color profile would be as follows: Yellow=3; Blue=0; Red=3; Purple=6. The most similar color profile in this case is "Blue", and the dog is therefore assigned a color of "Blue". Should the closest distance be shared by more than one color, tie breaking rules may be employed. These could include random assignment, assignment to the least or most populated color, attribute weighted assignment or other rules.

The color templates themselves may be created using cluster analysis of profiles of pets available for adoption. In one embodiment, color templates for four clusters for dogs and cats are created based on an exploratory data analysis. In one embodiment, centroid-based clustering can be used. Those skilled in the art will appreciate that other clustering algorithms may also be used. In centroid-based clustering, clusters are represented by a central vector, which may not necessarily be a member of the data set. When the number of clusters is fixed to k=4, k-means clustering gives a formal definition as an optimization problem: find the k cluster centers and assign the objects to the nearest cluster center, such that the squared distances from the cluster are minimized.

In the first embodiment, once the color is computed, at a minimum, a pet name, pet ID number, and color are stored in the pet profile storage (e.g., pet profile storage 40). In some embodiments, some or all of the entered pet data may be stored in the pet profile storage. Those skilled in the art will understand that the pet profile storage 40 may be implemented using a variety of techniques, applications and data structures. One non-limiting example data structure is illustrated in FIG. 3. In one embodiment, an array list is used. In another embodiment, a relational database might be used.

When a prospective adopter (e.g., prospective adopter 2) searches for a pet, the desired attributes are entered and submitted to the server 70 through the matchmaker user interface 50. Example attributes may include pet type, age or age range, living environment, child, other animal and elderly compatibility requirements, and whether the adopted pet is housebroken. The desired attributes are preferably entered by the prospective adopter by selection from among pre-defined attribute options in different categories, and are compiled to collectively form a desired-pet profile. Matchmaker user interface 50, in turn, transmits the desired pet profile data entered by the prospective adopter to the matchmaker.

The matchmaker 60 can be configured to receive the desired pet profile data and communicate same to classifier 30, as illustrated in FIG. 3. Classifier 30 can be configured to compute a color based on the desired pet attributes from the desired-pet profile, in the same manner as described above for the adoptable pet profile, and return a "desired color" to matchmaker 60. Matchmaker 60 can be configured to compare the desired color to the colors of available pets using their profiles stored in pet profile storage 40. The name, ID, and detailed profile data of matching pets are retrieved from the pet profile storage 40 and returned by matchmaker 60 to matchmaker user interface 50 for display to the inquiring prospective adopter. In one embodiment, additional pet metadata such as profile pictures and videos, immunization and spay/neuter records may also be presented via matchmaker user interface 50.

Adopter-Profile Influenced Matchmaking

In the first embodiment described above, the classifier makes use of only attributes from the adoptable pet profiles and desired pet profile when determining which of the pet profiles to display to the prospective adopter. Upon submission of a prospective adopter's desired profile, members of the color class "nearest" to that of the desired pet profile are returned to the matchmaker user interface 50 for display to the user along with suitable selection tools (e.g. an "adopt me" button for each profile) which the prospective adopter can use to select one of the pet profiles for adoption. The color codes are statically assigned to available pets and pet profiles desired by prospective adopters based on their similarity to a pre-defined color template. This presupposes that the prospective adopter has good insight into the attributes of pets that will yield the best match. This is not borne out by experience. Animal shelters' low adoption rates and relatively high return rates suggest the limitations of this approach.

Accordingly, while the first embodiment outlines the general layout of the system and the manner in which the prospective adopters and shelter personnel interact with the system via their user interfaces to enter desired-pet profiles and adoptable-pet profiles respectively, a number of enhancements in data and classifier design are possible that would improve the quality of recommendations. Accordingly, additional embodiments are described herein below that provide such enhancements.

Ideally, pet matching should leverage insights about both the pet and the prospective adopter. Thus, data used in recommendations may extend beyond the pet attributes and desired pet profile. For example, in addition to pet data, demographic, psychographic, and behavioral attributes of a prospective adopter can be included in the matching process. These can include attributes such as the prospective adopter's age, marital/family status (such as the age and presence of children), dwelling type (e.g. single family home or apartment, rural vs. urban) that may influence what might be the "right" pet to adopt by the prospective adopter.

In one embodiment, this "prospective adopter centric" data could be entered by the prospective adopter, directly through the matchmaker user interface 50. In another embodiment, such data could be appended from a third party consumer database, such as that available from Acxiom InfoBase Consumer at <<http://www.acxiom.com/site-assets/factsheet/factsheet-infobase-consumer-list/>> and that available from Epsilon TotalSource Plus at <<http://www.epsilon.com/pdf/TotalSourcePlus_Overview_0211.pdf>>. In the latter case where third party data is used, the matchmaker user interface can be configured to allow the prospective adopter to enter their name and address, telephone number, or other personally identifiable information (PII) through the matchmaker user interface. The matchmaker can be configured to match this PII against records in the consumer database, and append the desired demographic, psychographic, or behavioral data elements to the other data entered by the prospective adopter. FIG. 5 illustrates an example of an adopter profile 520 that is stored on a computer readable memory by the server 70 and that combines both the prospective adopter centric data and the desired-pet attributes into a single profile.

Predictive Matchmaking

With reference to FIG. 4, in one embodiment, the color classifier may be replaced or combined with a predictive model that would leverage the full complement of independent variables (e.g., pet profile, desired profile, prospective adopter's demographic/psychographic profile, etc.) to predict a dependent variable associated with the likelihood or quality of adoption. These techniques would leverage historic data from previous system usage, adoptions, and returns in order to train the model.

Many modeling techniques might be employed. For example, logistic regression is a statistical technique used for predicting the outcome of a categorical dependent variable (a dependent variable that can take on a limited number of categories) based on one or more predictor variables. Artificial neural networks (ANN) can also be used. The computational framework for implementing ANN is a well described process and neural networks have been used extensively for pattern recognition and classification problems.

The operation of an ANN classifier is now described. In one embodiment, an open-source ANN software application may be used (R Version 2.15.2, The R Foundation for Statistical Computing). An ANN consists of a series of nodes, "the neurons", with interconnected weighted edges, "the synapses", converging on an output. The mathematical equation determining the activation function, "action potential", of each node is a nonlinear weighted sum of its inputs which is called the activation function and is typically a sigmoid function such as the hyperbolic tangent or logistic functions. The node signals to the next nodes in the network in a layered, feed-forward topology until an output is reached.

In the embodiment shown in FIG. 4, a feed-forward neural network is used, comprised of an input layer, hidden neurons, and an output neuron. The neural network may be trained using backpropagation with a small decay term. Neurons utilized a sigmoid transfer function.

At the Input Layer, 300 of the ANN, the number of inputs is determined by the number of classification features. Minimally, the Classifier would make use of Adopter-Specified Desired Pet Attributes or the Adopter Demographic/Psychographic/Behavioral Attributes from the adopter profiles 520, and Individual Shelter Pet Attributes from the pet profiles 510. In a preferred embodiment, all types of attributes would be used with a goal of having the neural network divine which are most important in classification. The attributes may be either categorical (which are represented and presented to the ANN by assigning a number to each category) or numeric. Non-limiting examples of different attributes usable by the ANN are as follow:

1) Adopter-Specified Desired Pet Attributes, such as Breed, Age Range (<1 year, 1-4 years or 4+ years), Gender (Male/Female), Size (Small/Medium/Large), Living Environment (INDOOR/OUTDOOR/BOTH), Child-Friendly (YES/NO), Animal Compatible (true/false), Appropriate for Elderly (true/false), Gender (M/F) and Housebroken (true/false).
2) Adopter Demographic/Psychographic/Behavioral Attributes, which may include self-reported attributes as well as attributes appended from third party consumer databases, such as age, gender, marital status, age and presence of children, household income, dwelling type and dwelling size, etc.
3) Individual Shelter Pet Attributes, which would include similar attributes as those included in the Adopter-Specified Desired Attributes above.
4) System Attributes. These inputs might encompass historic (used during training and testing) or current (used when scoring animals in production) settings for things like Display Number and Display Order (which are described in detail further below).

Regarding Hidden Neurons, 310 in the ANN, there are no universal rules to govern the selection of the number of hidden neurons. A general rule of thumb is that the optimal size of the hidden layer is usually between the size of the input layer and the output layer. More hidden neurons generally results in better performance on the training data set. However, to promote good generalization performance, and avoid over-fitting, it is generally desirable to use a neural network with the minimum number of hidden units compatible with good training performance.

Referring to FIG. 4, a single output neuron 320 is used in the output. A threshold function of 0.5 was used to generate a classification decision. Any number of variables associated with the success of the adoption process may be used as outputs. For a binomial distribution, when the output neuron's sigmoid function output is greater than 0.5, the classification is "1" and when the output is less than 0.5 the classification is "0".

Any number of dependent variables associated with the likelihood or quality of adoptions could be utilized. Examples of dependent variables may include profile selection, success of adoption, and satisfaction with adoption. These options are further described as follows.

1) Profiles Selection. Data about the pet profiles actually accessed by a prospective adopter 2, through the matchmaker user interface 50, such as pet ID, page view times, etc. can be a good indicator of which pets the prospective adopter found of interest.

A clickable icon, button, picture or object or other selectable tool in the matchmaker user interface 50 may be displayed adjacent to an initial 'preview version' of a pet profile within a listing of such previews for a plurality of adoptable animals. The initial preview shows a partial selection of the full pet profile contents, and clicking or other selection of the "details" tool allows the user to access a more complete or detailed view of that particular profile. The system can thus track which pet profiles a prospective adopter accessed in detail, and how long the details were viewed before returning to the preview listing.

Data from previous system usage may be used to train the model to predict either the likelihood of access (a binomial variable with states of "1"=Accessed and "0"=Not accessed) or the duration of access. Once the model is trained, available pets can be dynamically scored for each prospective adopter, when recommendations are requested. In response to a search request received from the browser of the remote client device 74 of a prospective adopter 2, the server inputs attributes from the prospective adopter profile and all the pet profiles into the predictive model in order to score the pet profiles against one another based on either the probability that the prospective adopter will access the pet profile details or the predicted length of time that the prospective adopter is expected to view those profile details, The profiles of the top scoring pets are then returned by the server 70 to the browser of the remote client device 74 for browsing thereof by the prospective adopter.

2) Success of Adoption. An important goal for any pet matching system can be to generate successful adoptions. A more direct means of achieving this goal is to incorporate data on past adoptions and returns (i.e. animals that were adopted, but then subsequently returned to the shelter) into the model.

In one embodiment, the dependent variable is binomial (e.g. "1"=Successful adoption and "0"=No adoption). Given their cost, it is also important to reduce returns. If return data is available, the dependent variable might have a trinomial distribution (e.g. "1"=Successful adoption, "0"=No adoption and "−1"=Failed adoption/return).

Once the predictive model has been trained with historic data, available pets can be dynamically scored for each prospective adopter, when recommendations are requested (i.e. when that adopter sends an animal search request to the server from their respective client device). The profiles of the top scoring pets, corresponding to those most likely to be successfully adopted, would be returned in response to a search request from a prospective adopter.

3) Satisfaction with Adoption. In one embodiment, past adopters may be surveyed and asked to rate their satisfaction with their adopted pet. The survey may be completed through the matchmaker user interface 50, in which case the survey results are sent back to the server over the communications network 72 for automatic recordal of the survey results. Alternatively, the survey may be conducted externally of the system (e.g. by telephone, email, etc. by the shelter personnel), and the results are then entered into the system by shelter personnel through the profile manager user interface 10. The survey may employ an ordinal scale such as (1-extremely unhappy to 5-extremely happy). This survey score may serve as the dependent variable to be predicted by the model. The model may then serve to predict the level of happiness associated with the prospective adoption of available pets. The profiles of the top scoring pets, corresponding to those most likely to generate high adoption satisfaction levels, would be returned in response to a search request from a prospective adopter.

4) Shelter Operating Goals. Shelters often face budgetary constraints. Successfully adopted pets no longer need to be housed or fed, saving money for the shelter.

The expenditures required for upkeep vary by pet. In one embodiment of the system, each pet's ongoing costs would be captured in the pet profile 510. The ongoing cost may be food related, man-hour related, shelter-space related, or various combinations thereof, and may be expressed in terms of a dollar amount over a fixed duration of time (e.g. $/day, $/week, $/month, etc.). Alternatively, some expenses may be expressed in terms other than dollar amounts, for example occupancy space (expressed in area, e.g. square footage, or fractional amount, e.g. percentage, of overall available shelter space) or volume or mass of food consumed over a given timeframe if all shelter occupants consume the same food. The binomial/trinomial attribute associated with adoption could be multiplied by the pet's costs. In so doing, the ANN would be predicting the likely impact on the shelter's operating costs of displaying that animal's profile to the prospective adopter. Those pets exhibiting the largest projected decreases in shelter costs would be returned in response to a search request from a prospective adopter.

Another shelter goal might be achieving adoption of animals with the longest tenures at the shelter (i.e. pets with the longest duration of stay within the shelter organization's care). One simple way to implement that would be display pets in the descending order of tenure. However, this solution is less than optimal if it severely impacts adoption rates and the associate impact on tenure. An alternative approach would be to use both the tenure and likelihood of a successful adoption. The binomial/trinomial attribute associated with adoption would be multiplied by the pet's tenure, and then the result would be ranked from highest to lowest, whereby the highest ranked animals would be more desirable to display or highlight to the prospective adopter.

The forgoing paragraphs describe the system as returning the pet profiles with the best score to the remote device of the prospective adopter. In such instances the output from the predictive model is thus being used to filter out lower-scored pet profiles from the overall pool of adoptable pet profiles that are stored in the pet profile storage 40. This may be accomplished, for example, by using a threshold as a predetermined limit on the maximum number of profiles to return (e.g. return only the ten highest scoring pet profiles if there are more than ten available pets for adoption), or using a threshold on the actual score values assigned (e.g. return only the pet profiles having a score value greater than the threshold value).

Figure 1:
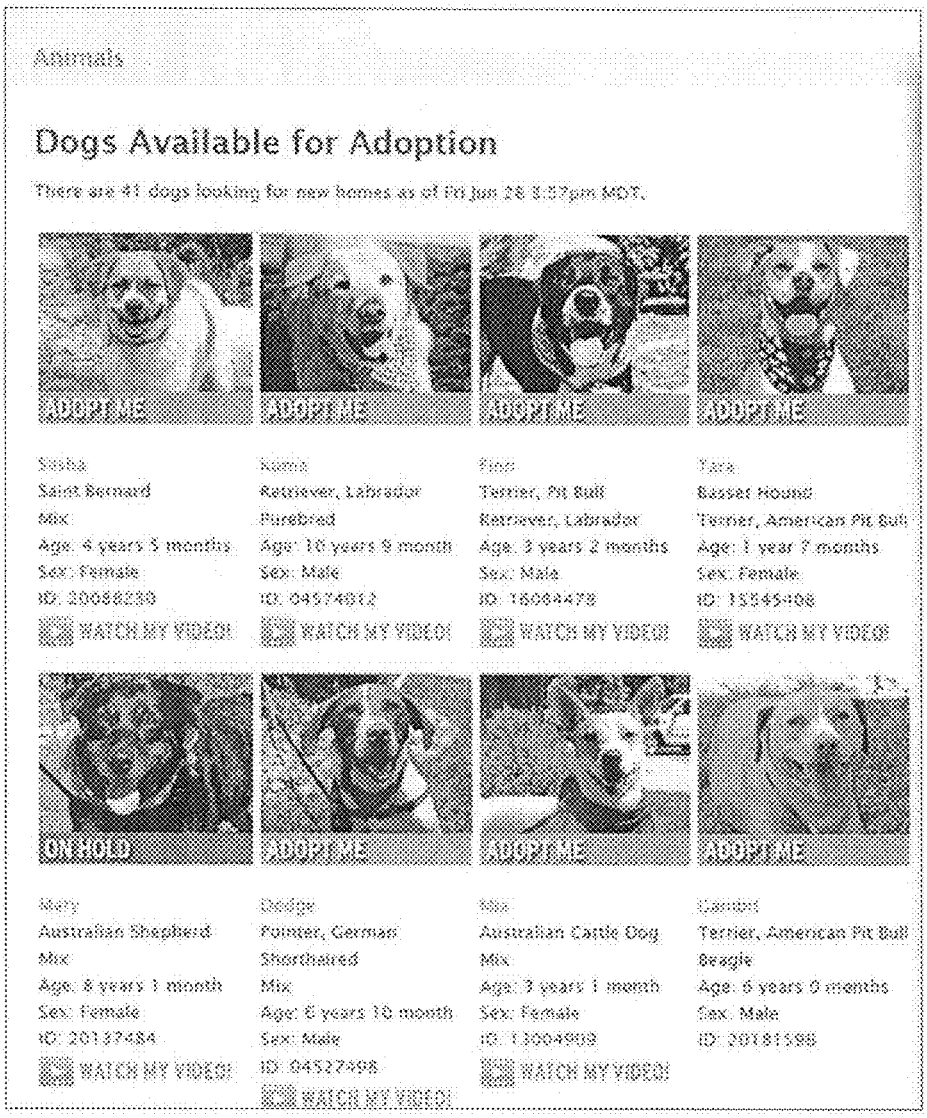
FIG. 1 is a screenshot of one example of a prior art pet adoption website.
Figure 2:
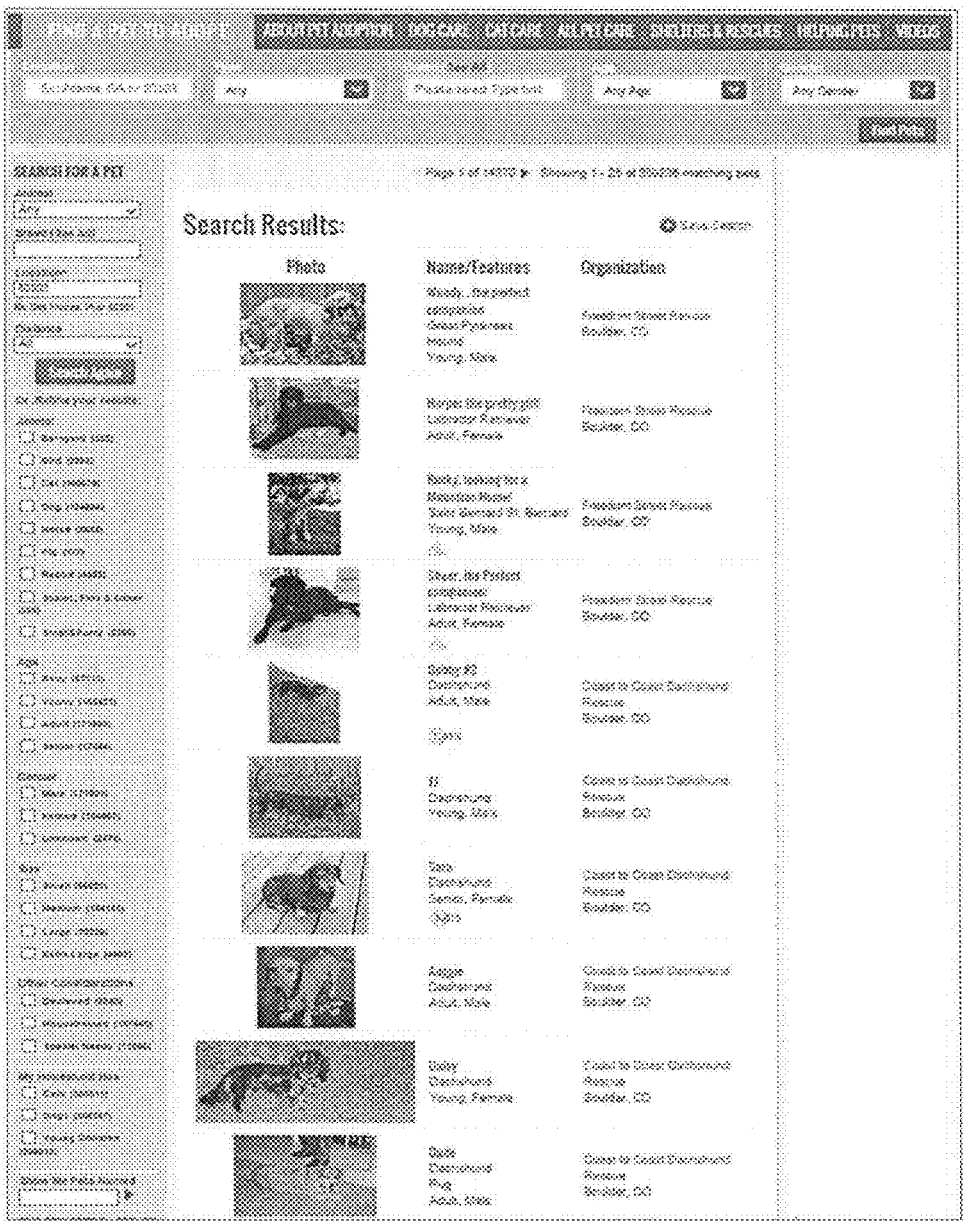
FIG. 2 is a screenshot of another example of a prior art pet adoption website.

As an alternative, or in addition, to filtering down the overall pool of pet profiles, the pet profile scores resulting from the predictive model can be used by the server to rank the pet profiles from best score to worst score, and then serve the ranked (and optionally filtered) collection of pet profiles to the remote device of the prospective adopter in a manner causing the collection of pet profiles to be displayed to the prospective adopter in the same order of best-to-worst score in the matchmaker user interface. A numerical rank value may be displayed in association with each pet profile in the matchmaker user interface to convey to the prospective adopter that the pet profiles displayed earlier in in the results list have been ranked higher. The pet profiles may be displayed in a two dimensional array of multiple rows and columns in the webpage or other user interface, similar to the prior art website snapshot in FIG. 1, in which case the score or rank of the pet profiles preferably increases in a left to right, top to bottom fashion. As another option, the pet profiles may be shown in a single row or column, similar to the prior art website snapshot in FIG. 2, with the profiles displayed in a top-down sequence from top ranked score to lowest ranked score. The prior art websites in FIGS. 1 and 2 also demonstrate how the preview/detail access feature of the present invention may operate, whereby clicking on a picture of the pet in question brings up a new webpage with a more detailed view of the profile of that particular pet. An "adopt me" button or other selection tool for each pet profile signals the server that the prospective adopter has selected a pet for adoption, which the system may automatically records as an achieved adoption.

To generate a suitable predictive model, the weights are adjusted in the ANN through a process called training. Before training commences, the initial weights are randomly selected.

A set of training data, created from previous system use, is pulled from Pet Profile Storage 40. Training data associated with previous use would be comprised of the input layer variables selected above, as well as the desired output variable. Typically, only a fraction of previous system use is leveraged to train the system. Each training sample would correspond to a single pet previously displayed to a Prospective Adopter through the system. For each training sample, the output of the ANN is compared to the actual result (an example might be whether the pet was successfully adopted or not). If ANN output differs from the actual result, an error signal is created and used to adjust the weights using an algorithm called backpropagation.

Training samples are presented sequentially in groups called iterations. The order of training samples is randomly selected in each iteration. Training may be conducted in batches of iterations, at the end of which the sum of squared errors (SSE) for the training set is computed. Training continued until either the SSE converged (change less than some small value) or a maximum number of iterations is reached.

The resulting system is then validated using data not previously seen by the ANN. If the ANN achieves good results on the test data, it is ready for production use. Note that training may continue as the ANN is used in production.

Once the system has been trained and validated, it is deployed in the System. When a Prospective Adopter uses the system (including entering a desired pet profile and/or demographic/psychographic/behavioral adopter attributes), the ANN dynamically scores each available pet. The highest scoring pets are selected, and their pet profiles returned to the Matchmaker User Interface 50 for display to the Prospective Adopter 2.

Although those skilled in the art will appreciate that many variations are possible, the illustrated embodiment of the predictive model matchmaking system makes use of a logical data model depicted in FIG. 5. FIG. 5 depicts a star schema in which a fact table records the disposition of every pet displayed to each Prospective Adopter using the system. The fact table, System Usage 500, contains a primary key (PK) called Transaction ID. Included in the fact table 500 are foreign keys Adopter ID (FK1) and Pet ID (FK2). System usage attributes such as whether the pet profile was accessed (Profile Access Flag) and the duration of access (Profile Access Duration) are included. Adoption disposition that resulted from the system usage, such as successful adoption, adoption/return, euthanasia, or no adoption are also included. Display Order and Display Number used during the session (as described herein further below) with the Prospective Adopter are also recorded in the fact table.

The fact table is linked to dimension tables including Pet Profile 510 and Adopter Profile 520. The linkage to Pet Profile 510 is done through primary key (PK) Pet ID. The Pet Profile contains attributes such as current Status (available for adoption, adopted, returned, euthanized), pet Type (e.g. dog, cat, etc.), Breed, Size, Age, Gender, compatibility with children, the elderly or other pets, and other pet attributes the shelter might deem important. To support the Color matching approach described in the first embodiment of the invention, Color may also included. This may be used to allow selection between color-based and prediction-based modes of operation, or the pet profile color and desired pet profile cover may be used as independent variables in the predictive model. In addition, the shelter intake date (and a derived attribute days in shelter), number of times the pet's profile has been displayed to a Prospective Adopter and number of previous accesses are recorded. Other attributes impacting shelter goals, such as housing expense, might also be included.

The Adopter Profile 520 dimension table includes attributes like the Name and Address/City/State/Zip of the Prospective Adopter (when available), self-reported or appended demographic/psychographic behavioral attributes such as Age, Income, Marital Status, and Presence of Children might be included. The demographic/psychographic/behavioral attributes available for use in predictive modeling are voluminous. Typically the selection of independent variable/elements to include would be determined by which are found to be predictive of the dependent variable. In addition, the Prospective Adopter's desired pet profile (Desired Type, Desired Breed, Desired Size, Desired Age, Desired Gender, Child Friendly/Other Pet Friendly) are also included. As mentioned above, desired Color (if known, or computed) may also be included.

When a prospective adopter chooses to conduct a search after having entered attributes for the adopter profile (which may be re-accessible later on by logging in to the system via a user ID and password combination that was entered in the matchmaker user interface during a user-registration process), a Transaction ID is created for each pet profile served to the prospective adopter, thereby associating the Pet ID of that pet profile with the Adopter ID of the prospective adopter conducting the current search. If the current prospective adopter selects a pet profile for adoption, the Adoption Disposition record for that Transaction ID is updated to indicate a successful adoption.

Accordingly, if this transaction took place during training of the ANN, this transaction denotes a record of an achieved adoption between a prospective adopter having the attribute values defined in his/her respective adopter profile and an adoptable animal having the attribute values defined in the animal's pet/profile, which influences the predictive model. For any pet profile served to the prospective adopter but not selected for an adoption, a Transaction ID is again created for use in training the predictive model, but no corresponding record of an achieved adoption is created.

As mentioned above, the adoption disposition record of any transaction in the system usage fact table may have possible values other than an indication of an achieved adoption. For example, if the subject pet has been euthanized, an update reflective of this fact can be entered into the system by shelter personnel 1 through the pet profile management user interface 10, in response to which the server creates an entry indicative of the pet's euthanization in the adoption disposition record of any transaction ID that the pet's profile is linked to. Similarly, if a previously adopted pet is subsequently returned to the shelter, the shelter personnel enters this update into the system through the pet profile management user interface 10, in response to which the server looks up the transaction ID corresponding to that adopter and pet, and changes the adoption disposition record in that transaction from an entry indicative of an achieved or successful adoption to one indicative of a returned or failed adoption. If the original adoption of the pet and return of the adopted pet takes place within a predetermined window of training time (i.e. a predetermined length of time during which the system is accumulating usage data for a training the predictive model, which in a non-limiting example may be somewhere between one and three months), then the transaction will not falsely reflect a successful adoption in the training of the model. If the model is being re-trained at regular intervals and the return of the adopted animal takes place after the training window in which the adoption took place, the returned adoption entry in the transaction record will be considered during a subsequent training epoch of the ANN, and thus counteract the influence of original transaction in relation to prediction of successful adoptions.

Order and Number of Pet Profiles Displayed

Display Order

Prior art systems also exhibit other shortcomings beyond their matching/pet profile selection algorithm. When faced with pages of pet profiles to review, prospective adopters disproportionately choose pets from the first pages. The number of pet profiles and the order in which they are displayed to the prospective adopter are not governed by explicit business rules designed to further the animal shelter's goals. Often, matching profiles are pulled and displayed in the order in which they are identified from an underlying pet profile database.

In the prior art, the rules governing the order in which pet profiles are displayed to prospective adopters cannot be specified by the animal shelter. The most common or default approach used by prior systems is to simply display the returned pet profiles in the order in which they are selected from the underlying data structure. Other options are contemplated by the present invention, including a random order display, an ordinal display (e.g., in a descending order) based on Classifier score, or a first in first out (FIFO) or last in last out (LIFO) display rule. The shelter personnel can accordingly select from different display order options, at least some of which may help accomplish particular shelter goals. For example, a FIFO display rule might be used to promote the pets with the longest tenure in the shelter. This would act to reduce the length of the longest tenures.

Accordingly, rather than relying on the vagaries of the underlying data structures and storage mechanisms, embodiments of the present invention can allow the display order to be specified. FIG. 6 illustrates the concept of a Display Order Management System incorporated into an overall pet adoption system of the type described above and illustrated in FIG. 3. Shelter Employee/Volunteer 1 enters the desired display order method into the system through the Pet Profile Manager User Interface 10 by selecting from among a plurality of different rule selection options presented therein, each of which corresponds to a different respective display-order sorting rule stored within a rules engine 100 in the computer readable memory of the server system 70. Examples might include:

- Random. The display order is randomly specified in which each candidate pet selected by the Classifier 30 has equal chance of being displayed in the first slot, the second slot, and so on.
- First in first out (FIFO). Candidate pets selected by the Classifier 30 are ordered based on the date in which they entered the shelter, with pets displayed in order from longest to shortest tenure.
- Last in first out (LIFO). Candidate pets selected by the Classifier 30 are ordered based on the date in which they entered the shelter, with pets displayed in order from shortest to longest tenure.
- Closest Shelter First, which is applicable when pets from multiple centers are displayed. To accommodate this, each adopter profile preferably includes adopter location data specifying their location (e.g. geographic coordinates obtained from an external geocoding resource for a residential or business address that was entered by the prospective adopter through the matchmaker user interface when creating their prospective adopter profile), and each pet profile includes a record of, or link to, the location data of the shelter in which that particular pet resides. The server can thus use the geographic co-ordinates of the prospective adopter and the shelter of each active pet profile in the pool of adoptable pets to calculate which adoptable pets are nearest to the adopter-associated location.
- Score-based. For example, candidates for adoption might be displayed in descending order with highest score first. These scores could reflect any number of attributes such as the probability of a successful adoption or the probability the candidate might be euthanized.

Once the desired display order method is entered by the shelter personnel 1, it is communicated to the Display Manager Rules Engine 100 at the server.

As described above, the Prospective Adopter 2 enters the desired attributes sought in a pet through the MatchMaker User Interface 110. The desired attributes are used by the Classifier 30, in part, to select a list of candidates that might be displayed to the Prospective Adopter 2. This list could conceivably include all pets at the shelter, or a reduced collection of pet profiles that has been filtered down from the larger overall pool of available pets, whether based on predictive modeling or non-predictive matchmaking techniques. The Display Manager Rules Engine 100 is used to determine the ordering based on the desired display order method specified by the shelter personnel 1. In predictive model embodiments, the actual candidates displayed to the Prospective Adopter 2 and their adoption disposition status (such as whether the Prospective Adopter 2 successfully adopted any of the displayed pets) are tracked and updated in the Pet Profile Storage 40. These updated data may be used to refine models and scores used in the Classifier 30 to improve the accuracy of future predictions.

Display Number

When faced with too many choices, prospective adopters may opt to select no pet at all, and so presenting too many pet options can be counterproductive. To address this issue, the present invention includes embodiments that can regulate the number of displayed pet profiles, for instance, to be a selected number between between a specified minimum and maximum that results in the highest adoption rates. In one embodiment, the number of pets displayed may be altered so as to optimize the adoption rate. In one embodiment, the number of pet profiles displayed may be randomly varied. The number of times the display number was used, and the number of resulting adoptions (or returns) may be recorded. When a display number with a statistically significant best adoption rate is determined, it can be used in lieu of other display numbers. This process may run continuously, or be re-run periodically to ensure the best value is used. More detail one such display-number optimizing embodiment is provided as follows.

Referring to FIG. 7, a Display Number Management System is incorporated into an overall pet adoption system similar to those of FIGS. 3 and 6, which as a result has a plurality of discrete modules, including pet profile manager user interface 10, display manager rules engine 100, matchmaker user interface 50, adoption disposition data collector 120, display number histogram 130, and probabilistic display number selector 140. The server 70 in this embodiment thus adds the adoption disposition data collector 120, display number histogram 130, and probabilistic display number selector 140 to the other computer program modules stored in the computer readable memory of the server computer(s) of FIGS. 3 and 6.

In one preferred embodiment of the present invention, the Display Number Management System operates as follows. Through the Pet Profile User Manager Interface 10, a Shelter Employee/Volunteer 1 enters either a fixed number of profiles to display per page or allows for an automated and optimized number to be selected by the system. These settings are captured in the Display Manager Rules Engine 100.

The Display Manager Rules Engine 100 determines the number of profiles to display per page in the Matchmaker User Interface 50 for viewing by the Prospective Adopter 2. Data on whether each Prospective Adopter 2 completed a successful adoption during any given search performed by that prospective adopter is captured by the Adoption Disposition Data Collector 120. For example, in embodiments employing a predictive model approach like that described herein above, the adoption disposition data may be recorded in the described manner in the system usage fact table 500. After the end of each search session performed by a prospective adopter, the Adoption Disposition Data Collector 120 thus may check the adoption disposition record of each transaction entry that was created in the system usage fact table 500 during that session in order to check for an 'achieved adoption' entry therein. If such an entry is found, the Adoption Disposition Data Collector 120 has thus determined that the search in question did result in an adoption. If no such entry is found, the Adoption Disposition Data Collector 120 knows that no adoption resulted from this search. The end of a search session may be signaled to the server either selection of a 'logout' option or similar search-termination tool by the prospective adopter in the matchmaker user interface, or by expiry of a time-out period (i.e. predetermined length of inactivity from the prospective adopter's device).

The adoption disposition data from the Adoption Disposition Data Collector 120 is used to update the Display Number Histogram 130. Initially, the Display Number Histogram is set equal across all display number values. Initial Histogram 131, illustrates the concept. Initial Histogram 131 depicts a histogram in which the number of permissible profiles to display per page varies between 1 and 10. That is, each bin of the histogram corresponds to a respective predetermined display number from among which the display manager rules engine can select the governing display number that dictates the particular number of pet profiles to serve per page to the browser of the prospective adopter's remote client device during a given search session. The histogram is set to 10 for each display number in the illustrated example. However, it will be appreciated that the initial default value may be varied within the scope of the invention, as may the overall number and values of the display numbers from which the rules engine can select.

As Prospective Adopters use the system while the display number optimization is in operation, the histogram is updated. In the event a successful adoption results from a given search session, the histogram value associated with the corresponding display number is increased. In one embodiment, the histogram value is incremented by 1. Conversely, if a successful adoption does not result from a Prospective Adopter's use of the system during a given search session, the histogram value associated with the corresponding display number is decremented. In one embodiment, the histogram is decremented by 1. Updated Histogram 132 illustrates changes in the histogram values that result from use of the system in the illustrated example. The updated histogram values reflects poor adoption results when the display number is less than 4 per page, and enhanced adoption results when the display number is greater than or equal to 5.

The Display Number Histogram 131 is used by Probabilistic Display Number Selector 140 to determine the display number to use for an initiated search session when the automated optimization mode has been selected by the shelter personnel. That value is in turn communicated to the Display Manager Rules Engine 100.

The histogram can be used to select the display number in any number of ways. In one embodiment, the probability that a given display number is selected is proportional to its histogram value $H_i$. With N possible display numbers, the probability for the $i^{th}$ display number value $P_i$ is given by:

$$P_i = \frac{H_i}{\sum_{i=1}^{N} H_i}$$

The Probabilistic Display Number Selector 140 uses these probabilities to select a display number to use in for the next search session initiated by a Prospective Adopter 2. The selected display number is provided to Display Manager Rules Engine 100. Accordingly, when the matchmaker user interface 50 on the prospective adopter's remote client device sends a search request to the server, the server performs its matchmaking routine (whether predictive, or non-predictive) to determine a collection of pet profiles for consideration by the prospective adopter, and then serves a first page to the prospective adopters browser that contains a selection of pet profiles from the collection in the quantity dictated by the display number selected by the Probabilistic Display Number Selector 140. So if the collection of pet profiles after the matchmaking routine is contains 100 profiles, and the Probabilistic Display Number Selector 140 has selected a display number of 10, the prospective adopter will be served an initial page of 10 pet profiles to browse. The prospective adopter can subsequently choose to optionally retrieve a subsequent page, in response to which the server will serve ten more profiles to the browser.

The display manager rules engine may apply the display-order rules (described above with reference to FIG. 6) together with the determined optimal display number (described in relation to FIG. 7). In such embodiments, the server will sort the collection of profiles according to the display order rule specified by the shelter personnel in order to generate display-order data that dictates the display order of the profiles in the prospective adopter's browser, and then sends initial search results by serving the ten pet profiles that are ranked highest in the display order to the browser of the prospective adopter. Should the adopter click on a link to a second page of results, the server will serve up the next ten highest ranked pet profiles.

In the illustrated embodiment of FIG. 7, the display number optimization runs continuously and the histogram is used to compute the probability that the given display number is selected in the next iteration. This way, as the system is used it naturally selects the optimal value more often. Alternatively, the system could employ a training period of predetermined length during which the adoption results are similarly tracked, and at the expiry of the training period, the display number having the greatest probability of adoption is selected as an optimal display number for ongoing use by the system. In one embodiment, rather than using the histogram to select the display number for each search session during the training period, the server could alternatively vary the display number by some other means, for example performing a random selection from among the predetermined display numbers, or sequentially cycling through the predetermined display values, either performing this random or sequential selection with every new search, or making a new selection periodically and using the selected display number for the next batch of searches (e.g. selecting a new display number at regular intervals of time, (e.g. hourly, daily, etc.) or in groups of searches (e.g. select a new display number for every other search, or every third search, etc.).

Those skilled in the art will appreciate that embodiments of a pet matching solution disclosed herein can be implemented in various ways. In some embodiments, a pet matching method can be implemented in a system having at least one processor and at least one non-transitory computer-readable medium storing instructions translatable by the at least one processor to cause the system to perform the method. In some embodiments, the method can be implemented in a computer program product having at least one non-transitory computer-readable medium storing instructions translatable by at least one processor to cause a system to perform the method.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Embodiments discussed herein can be implemented in a computer communicatively coupled to a network (for example, the Internet), another computer, or in a standalone computer. As is known to those skilled in the art, a suitable computer can include a central processing unit ("CPU"), at least one read-only memory ("ROM"), at least one random access memory ("RAM"), at least one hard drive ("HD"), and one or more input/output ("I/O") device(s). The I/O devices can include a keyboard, monitor, printer, electronic pointing device (for example, mouse, trackball, stylist, touch pad, etc.), or the like.

ROM, RAM, and HD are computer memories for storing computer-executable instructions executable by the CPU or capable of being complied or interpreted to be executable by the CPU. Suitable computer-executable instructions may reside on a computer readable medium (e.g., ROM, RAM, and/or HD), hardware circuitry or the like, or any combination thereof. Within this disclosure, the term "computer readable medium" or is not limited to ROM, RAM, and HD and can include any type of data storage medium that can be read by a processor. For example, a computer-readable medium may refer to a data cartridge, a data backup magnetic tape, a floppy diskette, a flash memory drive, an optical data storage drive, a CD-ROM, ROM, RAM, HD, or the like. The processes described herein may be implemented in suitable computer-executable instructions that may reside on a computer readable medium (for example, a disk, CD-ROM, a memory, etc.). Alternatively, the computer-executable instructions may be stored as software code components on a direct access storage device array, magnetic tape, floppy diskette, optical storage device, or other appropriate computer-readable medium or storage device.

Any suitable programming language can be used, individually or in conjunction with another programming language, to implement the routines, methods or programs of embodiments of the invention described herein, including C, C++, Java, JavaScript, HTML, or any other programming or scripting language, etc. Other software/hardware/network architectures may be used. For example, the functions of the disclosed embodiments may be implemented on one computer or shared/distributed among two or more computers in or across a network. Communications between computers implementing embodiments can be accomplished using any electronic, optical, radio frequency signals, or other suitable methods and tools of communication in compliance with known network protocols.

Different programming techniques can be employed such as procedural or object oriented. Any particular routine can execute on a single computer processing device or multiple computer processing devices, a single computer processor or multiple computer processors. Data may be stored in a single storage medium or distributed through multiple storage mediums, and may reside in a single database or multiple databases (or other data storage techniques). Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, or otherwise controlled by another process, such as an operating system, kernel, etc. The routines can operate in an operating system environment or as stand-alone routines. Functions, routines, methods, steps and operations described herein can be performed in hardware, software, firmware or any combination thereof.

Embodiments described herein can be implemented in the form of control logic in a combination of software and hardware. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It is also within the spirit and scope of the invention to implement in software programming or code any of the steps, operations, methods, routines or portions thereof described herein, where such software programming or code can be stored in a computer-readable medium and can be operated on by a processor to permit a computer to perform any of the steps, operations, methods, routines or portions thereof described herein. The invention may be implemented by using software programming or code in one or more general purpose digital computers, by using application specific integrated circuits, programmable logic devices, field programmable gate arrays, optical, chemical, biological, quantum or nanoengineered systems, components and mechanisms may be used. In general, the functions of the invention can be achieved by any means as is known in the art. For example, distributed, or networked systems, components and circuits can be used. In another example, communication or transfer (or otherwise moving from one place to another) of data may be wired, wireless, or by any other means.

A "computer-readable medium" may be any medium that can contain, store, communicate, propagate, or transport the program for use by or in connection with the instruction execution system, apparatus, system or device. The computer readable medium can be, by way of example only but not by limitation, an electronic, magnetic, optical, electromagnetic, infrared, or semiconductor system, apparatus, system, device, propagation medium, or computer memory. Such computer-readable medium shall generally be machine readable and include software programming or code that can be human readable (e.g., source code) or machine readable (e.g., object code). Examples of non-transitory computer-readable media can include random access memories, read-only memories, hard drives, data cartridges, magnetic tapes, floppy diskettes, flash memory drives, optical data storage devices, compact-disc read-only memories, and other appropriate computer memories and data storage devices. In an illustrative embodiment, some or all of the software components may reside on a single server computer or on any combination of separate server computers. As one skilled in the art can appreciate, a computer program product implementing an embodiment disclosed herein may comprise one or more non-transitory computer readable media storing computer instructions translatable by one or more processors in a computing environment.

A "processor" includes any hardware system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real-time," "offline," in a "batch mode," etc. Portions of processing can be performed at different times and at different locations, by different (or the same) processing systems.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, process, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

The following disclosures are hereby incorporated by reference herein.

1. "Pets by the Numbers," The Humane Society of the United States, Jun. 13, 2013, <<http://www.humanesociety.org/issues/pet_overpopulation/facts/pet_ownership_statistics.html>>.
2. "Animal Shelter Euthanasia," American Humane Association, 2011, <<http://www.americanhumane.org/animals/stop-animal-abuse/fact-sheets/animal-shelter-euthanasia.html>>.
3. "Frequently Asked Questions," National Council on Pet Population Study & Policy, 2009, <<http://www.petpopulation.org/faq.html>>.
4. "Facts about US Animal Shelters," FAQ, Misc., Pet Statistics, American Society for the Prevention of Cruelty to Animals, 2013, <<http://www.aspca.org/about-us/faq/pet-statistics.aspx>>.
5. 2012 Public Animal Shelter Report. NC Department of Agriculture and Consumer Services, Jun. 6, 2013, <<http://www.ncagr.gov/vet/aws/fix/documents/2012ShelterReportUpdated6-6-13pdfVersion.pdf>>.
6. Belur V. Dasarathy, "Nearest Neighbor (NN) Norms: NN Pattern Classification Techniques," IEEE Computer Society Press, Los Alamitos, Calif., 1991.
7. Richard O. Duda, Peter E. Hart and David G. Stork. *Pattern Classification*. John Wiley & Sons, Inc., New York, N.Y. Second Edition, 2001, pp. 187-192.

8. Hamming, Richard W., "Error detecting and error correcting codes", Bell System Technical Journal 29 (2), 1950, pp. 147-160.
9. Stanfill, C. & Waltz, D., "Towards memory-based reasoning," Communications of the ACM, 29 (12), 1986, pp. 1213-1228.
10. Cost, S. & Salzberg, S., "A weighted nearest neighbor algorithm for learning with symbolic features," Machine Learning, 10, 1993, pp. 57-78.
11. MacQueen, J. B., "Some Methods for classification and Analysis of Multivariate Observations," Proceedings of 5th Berkeley Symposium on Mathematical Statistics and Probability 1, University of California Press, 1967, pp. 281-297.
12. Hosmer, David W., and Stanley Lemeshow. *Applied Logistic Regression*. John Wiley & Sons, Inc., New York, N.Y. Second Edition, 2000.
13. Long, J. Scott. *Regression Models for Categorical and Limited Dependent Variables*. Thousand Oaks: Sage Publications, 1997.
14. Anderson, James A., and Edward Rosenfeld. *Neurocomputing: Foundations of Research*. Cambridge, Mass.: MIT, 1988.
15. Rumelhart, David E., and James L. McClelland. *Parallel Distributed Processing: Explorations in the Microstructure of Cognition*. Vol. 1. Cambridge, Mass.: MIT, 1986.
16. Rumelhart, David E., and James L. McClelland. *Parallel Distributed Processing: Explorations in the Microstructure of Cognition*. Vol. 2. Cambridge, Mass.: MIT, 1988.
17. Jeatrakul, P., and K. W. Wong, "Comparing the Performance of Different Neural Networks for Binary Classification Problems," 2009 Eighth International Symposium on Natural Language Processing, IEEE, 2009, pp. 111-115.
18. Zhang, Gouquiang P., "Neural Networks for Classification: A Survey." IEEE TRANSACTIONS ON SYSTEMS, MAN, AND CYBERNETICS, PART C: APPLICATIONS AND REVIEWS, Vol. 30, No. 4, November 2000, pp. 451-462.

The invention claimed is:

1. A method of optimizing a display quantity of adoptable pet profiles that are to be displayed to a prospective pet adopter in a computer-implemented animal adoption system, the method comprising:

(a) maintaining by a server system a plurality of frequency count values, each frequency count value corresponding to one of a plurality of predefined display numbers;

(b) for each one of a plurality of prospective pet adopters, (i) receiving by the server system a search request over a communications network from a respective remote client device operated by said prospective pet adopter;

(ii) in response to the search request from the respective remote client device of said prospective pet adopter, selecting by the server system a predefined display number from the plurality of predefined display numbers, wherein the predefined display number which is selected varies among different occurrences of step (a)(ii);

(iii) serving by the server system to a browser of the respective remote client device for display in a user interface that includes a selection tool for allowing said prospective pet adopter to select for adoption any of a plurality of pet profiles served to said respective remote client device, a number of adoptable pet profiles equal to the predefined display number selected by the server system;

(iv) incrementing the frequency count value corresponding to the predefined display number selected by the server system if the server system receives confirmation from the respective remote client device that said prospective pet adopter has chosen an animal for adoption from among the number of adoptable pet profiles that were served to the respective remote client device;

(c) for an additional prospective pet adopter, (i) receiving by the server system a search request over the communications network from a respective remote client device operated by said additional prospective pet adopter;

(ii) in response to the search request from the respective client device of said additional prospective pet adopter, determining by the server system the frequency count value having the largest value; and (iii) serving by the server system to a browser of the respective remote client device a number of adoptable pet profiles equal to the predefined display number that corresponds to the largest frequency count value determined by the server.

2. The method of claim 1 wherein step (b)(iv) further comprises decrementing the frequency count value corresponding to the predefined display number selected by the server system if the server system receives confirmation from the respective remote client device that said prospective pet adopter did not select any animal for adoption from among the number of adoptable pet profiles that were served to the respective remote client device.

3. A non-transitory computer readable medium having stored thereon computer readable statements and instructions that, when executed by a processor of the server system of claim 1, cause the system to perform the method of claim 1.

* * * * *